US007308739B2

(12) United States Patent
Andersen et al.

(10) Patent No.: US 7,308,739 B2
(45) Date of Patent: Dec. 18, 2007

(54) ADJUSTABLE CLIP ASSEMBLY

(76) Inventors: Todd D Andersen, 1225 E. Sunset Dr., #377, Bellingham, WA (US) 98226; Robert M Cameron, 1225 E. Sunset Dr. #377, Bellingham, WA (US) 98226

( * ) Notice: Subject to any disclaimer, the term of this patent is extended or adjusted under 35 U.S.C. 154(b) by 655 days.

(21) Appl. No.: 09/870,858

(22) Filed: May 30, 2001

(65) Prior Publication Data

US 2002/0000027 A1 Jan. 3, 2002

Related U.S. Application Data

(60) Provisional application No. 60/208,122, filed on May 30, 2000.

(51) Int. Cl.
*F16B 2/22* (2006.01)

(52) U.S. Cl. ..... 24/535; 24/562; 24/569

(58) Field of Classification Search ..... 24/569, 24/535, 502, 514, 525, 67.1, 561, 562, 564, 24/571, 556, DIG. 22, 507, 521, 555; 968/668–669; 294/99.2, 99.1; 269/254 R, 239, 218; 81/111–113, 81/901, 487, 326, 327

See application file for complete search history.

(56) References Cited

U.S. PATENT DOCUMENTS 714,348 A * 11/1902 Youngblood
794,561 A * 7/1905 Spencer
969,695 A * 9/1910 Holsey
1,331,851 A * 2/1920 Ouzoun-Boghossian
3,177,542 A * 4/1965 James ..... 24/115 R
3,896,527 A * 7/1975 Miller et al. ..... 24/499
4,097,169 A * 6/1978 Kelly
4,170,995 A * 10/1979 Levine et al.
4,534,089 A * 8/1985 Swan ..... 24/559
4,733,988 A * 3/1988 Kelly
4,763,390 A * 8/1988 Rooz ..... 24/487
4,917,677 A * 4/1990 McCarthy
5,046,222 A * 9/1991 Byers et al.
5,245,715 A * 9/1993 Dinkins ..... 5/417
5,388,313 A 2/1995 Cameron
5,529,083 A * 6/1996 Martin ..... 135/31
D386,076 S * 11/1997 Moore

FOREIGN PATENT DOCUMENTS

EP 858930 A1 * 8/1998

* cited by examiner

*Primary Examiner*—James R Brittain
(74) *Attorney, Agent, or Firm*—Todd N. Hathaway

(57) ABSTRACT

An adjustable clip for gripping a tarp or the like. There are first and second jaw portions having first ends that are joined by a hinge and second ends that are spread apart to form a receiving area. A finger-operated screw or threaded knob is mounted to the jaw portions at a location between the first and second ends, so that the jaw portions are urged together in response to tightening of the screw or knob. The hinge may be a live hinge for resiliently biasing the jaw portions apart, and the jaw portions and live hinge may be formed as a unitarily molded structure. An attachment portion extends from the hinge and has at least one opening for receiving a rope or other cord therein. The jaw portions are provided with surface contouring for securely gripping the sheet material of the tarp while minimizing damage thereto. The grip force of the assembly can be adjusted by tightening or loosening the threaded knob or screw as desired.

1 Claim, 2 Drawing Sheets

ADJUSTABLE CLIP ASSEMBLY

This application claims the benefit of U.S. Provisional Application Ser. No. 60/208,122 filed May 30, 2000.

BACKGROUND

1. Field of the Invention

The present invention relates generally to clips and similar gripping devices, and, more particularly, to a thumbscrew-operated clip for gripping the edges of tarps formed of plastic, cloth or other material.

2. Related Art

The problem of how to secure a tarp against environmental conditions is one of long standing. By their very nature, tarps are intended for use as protection against the weather and are therefore often subjected to high winds. This is true not only in stationary installations, but also where a tarp is used to cover a load on a moving vehicle, such as over a truck bed or rail car.

For years, many tarps have been provided with grommets along their edges to provide attachment points for ropes or other hold-down lines. This adds significantly to the cost of manufacturing the tarp, and unfortunately offers only a partial solution. For example, the grommets sometimes tear out of the edges of the tarp, which can render the tarp useless unless some other means can be found for attaching tie-down lines to its edges. Furthermore, the grommets are ordinarily provided only at widely spaced locations (e.g., at spacing of perhaps three feet or so), which makes it difficult or impossible to attach additional hold-down lines at other points where they may be needed in order to provide a tight fit or to resist wind forces.

Still further, some tarps are not provided with any grommets at all such as VISQUEEN™ and similar plastic sheeting, for example, which makes it extremely difficult to secure these in place. Users have resorted to the expedient of passing ropes or shock ("bungee") cords over the tops of the sheeting and/or weighting them with bricks, cinder blocks, pieces of wood and similar objects, which is neither secure nor practical in many circumstances.

A number of clip-like attachment devices have been proposed in prior art, principally for use with clothing and woven fabric material. For example, the traditional "suspender clip" uses a pair of metal jaws that are forced together by a clasp mechanism. The sharp, pointed jaws of these devices tend to cause excessive damage and wear to the fabric, and are simply incapable of firmly gripping plastic sheeting or other comparatively thin material without tearing or destroying it. This tendency is complicated by the fact that, due to the nature of the clasp mechanism, this type of clip can only exert a fixed amount of gripping force between the jaws, i.e., the grip cannot be adjusted to be either tighter or looser, as may be needed in particular instances or for use with certain materials. Furthermore, the metal "suspender clip" devices are subject to breakage and rapid wear, and are difficult to operate when wet and cold.

The locking clip disclosed in U.S. Pat. No. 5,388,313 (Cameron) addresses a number of these issues, and is highly effective for many applications. However, the toothed ramp mechanism of this device limits the clamping force to a predetermined range (i.e., between finite upper and lower limits), whereas in some instances it may be desirable to be able to exert a greater or lesser degree of clamping force against the material; for example, when used with certain very thin, slippery or wet materials, it may be desirable to exert a much higher degree of clamping force in order to establish a firmer grip on the material. Furthermore, the teeth on the device shown in the '313 patent are shown mainly as having the configuration of a series of transversely extending ridges or corrugations; again, while this configuration is very effective for use with many types of materials, other materials may have a tendency to either slip through or tear between the ridged teeth, particularly if forces are applied in a somewhat crosswise direction with respect to the jaws of the clip.

Accordingly, there exists a need for an improved form of clip apparatus which permits an expanded range of grip forces to be exerted against sheet material between the jaws thereof, and which permits a comparatively high grip force to be exerted when desired. Furthermore, there exists a need for such a clip apparatus that is capable of accommodating tarps and materials having a variety of thicknesses. Still further, there exists a need for such a clip apparatus having an arrangement of teeth, which enables the apparatus to establish effective engagement with thin, slick or otherwise hard to grip sheet material. Still further, there exists a need for such a clip apparatus that will minimize damage to the fabric, plastic or other tarp material with which it is used. Still further, there exists a need for such a clip apparatus which is reliable and durable, and which is economical to manufacture.

SUMMARY OF THE INVENTION

The present invention has solved the problems cited above, and is a clip assembly having upper and lower jaw portions and a thumbscrew mechanism for forcing the jaw portions into gripping engagement with the sheet material of a tarp.

The upper and lower jaw portions may be joined by a live hinge at a common base, and may be formed as a unitary structure formed of molded resilient material. The resilient material may be injection molded plastic. An attachment portion may be provided for attaching a rope or other line to the assembly.

The thumbscrew-operated tightening mechanism may comprise a threaded shaft for drawing the upper and lower jaw portions together in response to rotation thereof. The shaft may include a threaded portion for engaging a corresponding threaded bore in one of the jaw portions, and an unthreaded portion for engaging the other jaw portion so as to draw the jaw portions together in response to rotation of the shaft. Alternatively, a separate threaded member may engage the threaded end of the shaft and bear against the surface of the associated jaw portion for exerting compressive force against the jaw portion. The separate threaded member may comprise an internally threaded nut or knob.

The jaw portions may comprise contoured surfaces for engaging the sheet material of the tarp that is gripped therein. The contoured surfaces may comprise a plurality of discreet teeth and corresponding sockets for receiving the teeth, so that the sheet material of the tarp is forced into the receptacles by the teeth when the jaw portions are tightened thereon. The teeth and sockets may have a generally symmetrical configuration within the plane of the tarp material for evenly distributing loads thereto. The symmetrical teeth and sockets may comprise corresponding hemispherical teeth and receptacles. Alternatively, the contoured surfaces may comprise a plurality of transverse, inter-fitting ridges for engaging the sheet material. The transverse ridges may be provided with surface texturing for gripping the sheet material; the surface texturing may comprise a multiplicity of small, raised protrusions formed on said ridges on said jaw portions.

The attachment portion of the assembly may comprise a through opening formed in the outer end of the assembly for attachment of a rope or other line thereto. The attachment portion may further comprise a hook opening for receiving a rope or other line therein without this having to be tied to the clip assembly. The hook opening may comprise a mouth portion having a width somewhat smaller than the diameter of the hook opening, so that the hook opening will retain the rope or other line therein after the rope or other line has been pressed through the mouth portion of the opening.

These and other features and advantages of the present invention will be better understood from reading the following detailed description with reference to the accompanying drawings.

DETAILED DESCRIPTION

Figure 1:
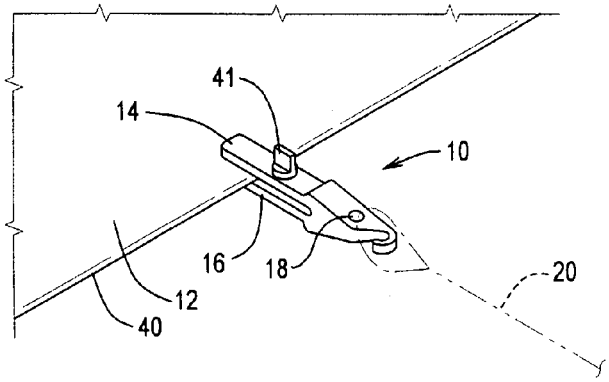
FIG. 1 is a perspective view of a clip assembly in accordance with the present invention, this being shown mounted to the edge of an exemplary tarp so as to attach a rope or other line thereto.

The following detailed description is made with reference to the attached figures, in which like reference numerals refer to like elements in the structures that are shown therein. As used in this description and the appended claims, the term "tarp" includes all forms of sheet material, whether specifically used as a covering against the weather or for other purposes. Such sheets may be formed of plastic, cloth, cloth having a vinyl, rubber or other covering, or of any other suitable material.

FIG. 1 shows a clip assembly 10 in accordance with the present invention mounted to the edge of an exemplary tarp 12. As can be seen, the edge of the tarp is gripped between upper and lower jaw portions 14, 16 of the assembly, while an extension at the outer end of the assembly is provided with a through opening 18 for attachment of a rope 20, a shock cord, or other line/cord.

Figure 2:
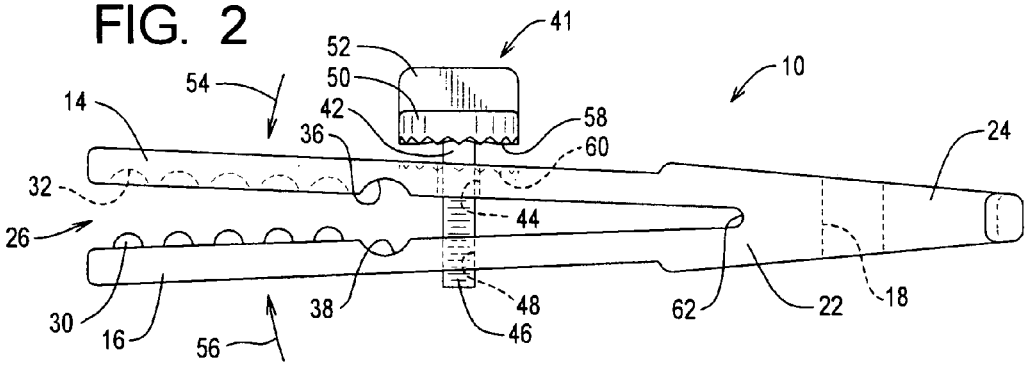
FIG. 2 is a side, elevational view of the clip assembly of FIG. 1, showing the configuration of the thumbscrew which is used to tighten the assembly, and the configuration of the teeth on the jaw portions thereof, in greater detail.

As can better be seen in FIG. 2, the upper and lower jaw portions 14, 16 of the assembly are joined at a common base by a live hinge 22. The jaw portions, the hinge 22, and the rearwardly extending attachment portion 24 are thus suitably formed as a single unit, as from injection molded plastic, for example. The material of which this structure is formed preferably has a predetermined degree of resilient flexibility, so that the jaw portions 14, 16 move resiliently together and then back apart as the assembly is alternately tightened and loosened. Glass fiber reinforced molded nylon is eminently suitable, but it will be understood that any other suitable material may be used, such as molded polypropylene, for example.

As can be seen, the upper and lower jaw portions 14, 16, when in their initial, relaxed configuration, extend at relatively narrow (e.g., 5-10°) included angle from their common base, thereby defining a jaw opening 26 that is sufficiently wide to receive the edges of tarps having a wide range of thicknesses.

Figure 3:
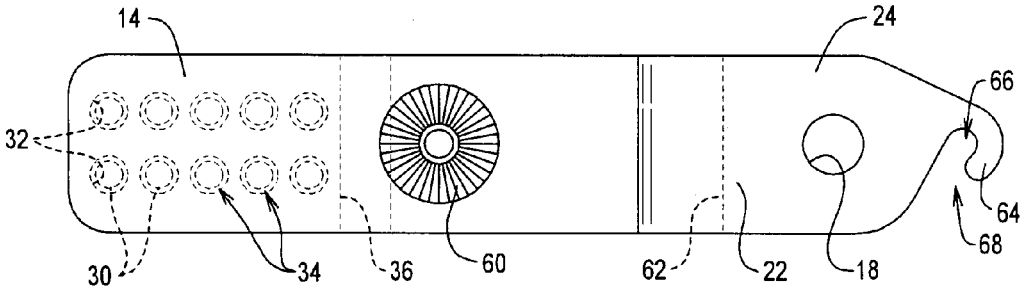
FIG. 3 is a top, plan view of the clip assembly of FIG. 1 with the thumbscrew thereof having been removed, showing the arrangement of ratchet teeth on the surface of the upper jaw portion thereof which engage corresponding teeth on the thumbscrew so as to prevent inadvertent loosening of the assembly.

In the embodiment which is shown in FIG. 2, the opposing inner surfaces of the upper and lower jaw portions are formed with a series of protruding teeth 30 and corresponding sockets 32. The jaw portions can thus be forced together until their inner surfaces bear flat against one another, with individual teeth being received in the corresponding sockets. In the embodiment that is illustrated, the teeth and sockets have matching, generally hemispherical contours. As can be seen in FIG. 3, the sockets are formed with slightly larger radii than the protruding teeth, thereby defining small gaps 34 for accommodating the thickness of the tarp material therein. The teeth/sockets having the hemispherical contours shown in FIG. 2 have the advantage of minimizing damage to the sheet material of the tarp, however, it will be understood that; in other embodiments, the teeth and sockets may have somewhat different configurations, e.g., they may have somewhat cylindrical, peg like configurations, may have square or rectangular contours, and so on.

In the embodiment which is illustrated in FIGS. 2-3, the upper and lower jaw portions 14, 16 also include corresponding upper and lower transverse channels 36, 38. As can be seen, these are suitably formed with corresponding, somewhat hemi-cylindrical contours, arranged to extend in somewhat coaxial relationship when the jaw portions are brought together so as to define an area for receiving and engaging the rope and/or hem 40 (see FIG. 1) which is found along the edges of many tarps. This not only increases the effectiveness of the grip, but also takes advantage of the strength of the rope/seam so as to reduce the possibility of tearing the main sheet material of the tarp.

Thumbscrew actuating mechanism 40 is located rearwardly of channels 36, 38, near the mid-point of the upper and lower jaw portions 14, 16. As can be seen, this includes a threaded shaft 42 that passes through a cooperating bore 44 in the upper jaw portion 14, and which has a threaded lower end 46 which engages a corresponding threaded bore 48 in the lower jaw portion 16. A knob portion 50 having a projecting flange 52 is mounted to the upper end of shaft 42 for manual rotation of the thumbscrew, as between the thumb and forefinger of an operator's hand.

Accordingly, rotation of the thumbscrew in a first (e.g., clockwise) direction tends to force the head of the thumbscrew downwardly against the upper surface of the upper jaw portion 14 while the threaded lower end of the shaft draws the lower jaw portion 16 upwardly in the opposite direction, thus forcing the two jaw portions together in the directions indicated by arrows 54, 56 in FIG. 2. A plurality of radially extending teeth 58 on the bottom of the thumbscrew knob 50 engage a corresponding series of teeth 60 formed on the upper surface of jaw portion 14 so as to act somewhat in the manner of a ratchet mechanism, preventing the thumbscrew from inadvertently backing off and loosening. As can be seen, however, the teeth are preferably sloped in both directions so as to be able to ride over one another in response to intentional twisting of the knob by an operator, this being facilitated by the resilience of the molded plastic material of which the assembly is preferably formed. The location of the thumbscrew mechanism, midway along the jaw portions and well forward of their V-shaped apex 62, provides highly effective leverage/clamping action in response to tightening of the mechanism. Furthermore, the amount of grip force exerted by the two jaw portions is incrementally adjustable by simply rotating the thumbscrew knob 50 in one direction or the other. In the event that a comparatively high degree of grip force is required (for example, to hold a thin or slippery material), this can be achieved simply and conveniently by further tightening of the thumbscrew, the length of the threads on the shaft preferably being somewhat longer than that required to merely bring the upper and lower jaw portions into face-to-face abutment.

As the upper and lower jaw portions 14, 16 are forced together against the two sides of the fabric or other material of the tarp, the individual teeth 30 tend to force the material into the corresponding sockets 32. As described above, this ensures a firm frictional engagement at a plurality of discrete locations, thereby providing effective distribution of loads into the fabric or other material of the tarp. Furthermore, because the teeth are generally symmetrical in the plane of the sheet material, the loads are distributed in a somewhat omni-directional fashion around each of the teeth so as to evenly load the fibers (or other material) and reduce the likelihood of tearing or other damage.

As was noted above, the attachment portion of the assembly extends rearwardly of the apex of the jaw portions and includes an opening 18 for attachment of a loop or bite of rope or other line. Furthermore, as is best seen in FIG. 3, the terminal end of the attachment portion preferably includes a hook opening 64 which defines a receiving area 66 into which a rope or other line can be inserted without having to be tied to the assembly; as can be seen, the mouth 68 of the hook opening is necked down somewhat (i.e., this width is preferably somewhat smaller than the diameter of the receiving area 66 itself), so that the resilient material of the hook flexes to allow the rope or other line to be pressed through the mouth and into the receiving area and then springs or "snaps" back to retain the line within the hook.

Figure 4:
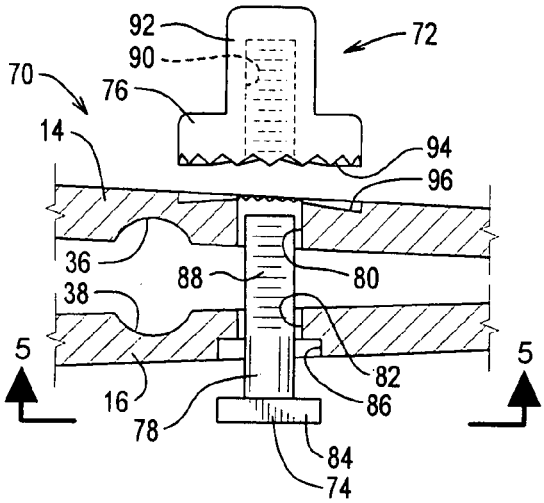
FIG. 4 is a cross-sectional view taken longitudinally through the thumbscrew and bolt of a clip assembly in accordance with a second embodiment of the present invention, in which a threaded bolt extends through the upper and lower jaws for tightening thereof in response to rotation of the thumbscrew.
Figure 5:
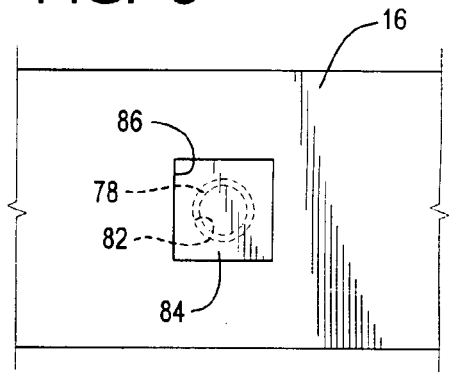
FIG. 5 is a bottom, plan view of the thumbscrew mechanism of FIG. 4, showing the rectangular head of the bolt and a corresponding socket in the lower jaw portion of the assembly which prevents the head of the bolt from rotating therein as the thumbscrew is tightened/loosened.
Figure 6:
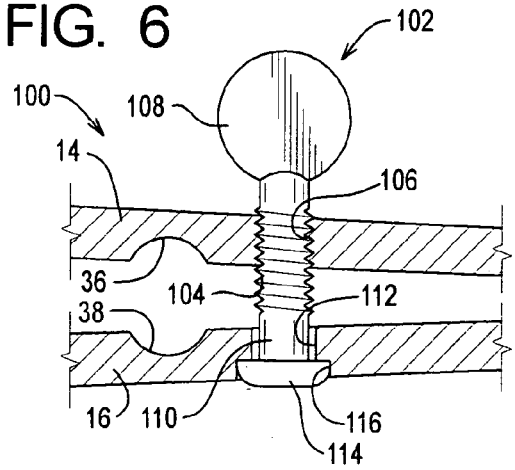
FIG. 6 is a cross-sectional view, similar to FIG. 4, showing the thumbscrew mechanism of a clip assembly in accordance with another embodiment of the present invention, in which the thumbscrew rotates a threaded shaft which cooperates with a threaded bore in the upper jaw portion while an unthreaded boss on the lower end of the screw reacts against the lower jaw portion of the assembly.

FIGS. 4-6 show additional embodiments of clip assembly in accordance with the present invention in which the thumbscrew mechanisms differ somewhat from that shown in FIGS. 1-3.

In particular, FIGS. 4-5 provide partial views of a clip assembly 70 having a thumbscrew mechanism 72 in which there is a separate bolt 74 and rotatable knob 76. As can be seen, the shaft 78 of the bolt passes vertically through cooperating bores 80, 82 in the upper and lower jaw portions 14, 16, with the head 84 of the bolt being received in a corresponding socket 86 in the bottom of the lower jaw portion 16. As can be seen in FIG. 5, the head of the bolt is square or otherwise configured to engage the edges of socket 86 so as to prevent the bolt from turning relative to the lower jaw portion 16; the head of the bolt may also be press-fit within the socket 86, so as to prevent it from falling out when the knob is remove. Furthermore, the head of the bolt may be provided with one or more upstanding ridges 87 or other projections that extend into the area between the two jaw portions, so as to act as a stop which prevents the jaw portions from bending or collapsing inwardly by an excessive amount as the knob is tightened.

The threaded upper end 88 of the bolt, in turn, engages a corresponding threaded bore 90 within knob 76. Thus, rotation of the knob in a first direction draws the bolt upwardly against the lower jaw portion while the knob presses downwardly against the upper jaw portion, thereby forcing the jaw portions together in the same manner as described above, while rotation in the opposite direction allows the jaws to relax and move apart due to the resilience of the live hinge. As with the knob 50 described above, knob 76 is provided with an upwardly projecting flange 92 for rotation between the user's fingers, and a plurality of radially extending teeth 94 on its bottom surface which engage corresponding teeth 96 on the upper surface of jaw portion 14 so as to prevent unintended rotation/loosening of the knob.

FIG. 6 provides partial view of a clip assembly 100 in accordance with an embodiment of the invention having another version of thumbscrew mechanism 102. As can be seen, this mechanism includes a unitary bolt having a threaded shaft 104 that engages a corresponding threaded bore 106 in the upper jaw portion 14. A flange portion 108 is formed on the upper end of the bolt, while the unthreaded lower end 110 of the bolt passes through a cooperating bore 122 in lower jaw portion 16. A hub or boss 114 is mounted on the lower end of a shaft, and is received for rotation in a corresponding socket 116 that is formed in the bottom of the lower jaw portion 16. Thus, in response to rotation of the flange portion 108, the threaded shaft and bore cooperate to drive the upper jaw portion flange downwardly, while the rotating hub 114 reacts against socket 116 to draw the lower jaw portion upwardly in the opposite direction, thereby generating the gripping action between the two jaw portions.

Figure 7:
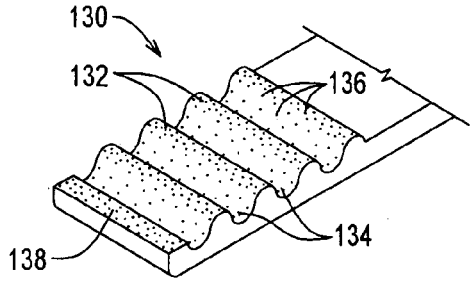
FIG. 7 is a partial, perspective view of one of the jaw portions of a clip assembly in accordance with another embodiment of the present invention, showing a second arrangement of engagement surfaces, in which there is a series of transverse, overlapping ridges on the jaw portions having raised surface texturing for gripping the sheet material of the tarp therein.

FIG. 7, in turn, shows a jaw portion 130 of a clip assembly in accordance with another embodiment of the present invention, this having an engagement surface that is a contoured differently from that described above. As can be seen, the engagement surface includes a plurality (e.g., four) of transversely extending ridges 132 separated by corresponding valleys 134. Corresponding ridges and valleys are formed on the opposing jaw portion (not shown), but are offset so as to interfit within the valleys/ridges of the first member, i.e., the ridges on the first jaw portion fit within the valleys of the other jaw portion as the two jaw portions are brought together, and vice-versa.

As can be seen, the ridges and valleys preferably have a rounded (e.g., undulating or sinusoidal) contour, rather than a sharp-edged profile. As compared with sharp-edged teeth, this arrangement has the advantage of minimizing damage to the fibers or other material of the tarp that is gripped therein, which in turn allows higher engagement pressures to be exerted (as by tightening the adjustment knob) without fear of damaging the tarp. The ridges/valleys are preferably provided with surface texturing for enhancing their grip against the sheet material of the tarp. Suitably, this can be in the form of a multiplicity of raised protrusions or "bumps", giving the surface texturing a grainy consistency somewhat like that of coarse sandpaper. It will be understood, however, that the surface texturing may have other consistencies and may also have other forms, such as a knurled or cross-hatched pattern or a multiplicity of small ridges, for example; moreover, the surface texturing may be distributed over the entire engagement surface of the jaw portion as shown in FIG. 7, or may be confined to particular contact areas, such as the tops of the ridges and bottoms of the valleys, for example. Still further, although ridges having rounded profiles are generally preferred, it will be understood that sharp-edged ridges may be used in some embodiments.

As can be seen with further reference to FIG. 7, the forward edges of the jaw portions preferably terminate in half height ridges or lips 138 that are brought together pincer-like as the jaw portions are closed, thereby enhancing the grip and helping to prevent the sheet material of the tarp from sliding between the jaws of the assembly.

It will be understood that other embodiments of the present invention may employ jaw portions, teeth, thumbscrew mechanisms or other components that vary somewhat from the preferred embodiments shown and described herein; for example, the thumbscrew mechanism in some embodiments may have threaded shafts and/or threaded bores (having threads in opposite directions) in both the upper and lower jaw portions. It is therefore to be recognized that various alterations, modifications and/or additions may be introduced into the constructions and arrangements of parts described above without departing from the spirit or ambit of the present invention.

What is claimed is:

1. An adjustable clip assembly, comprising:

first and second jaw portions, said jaw portions having first ends that are joined together and second ends that are spread apart so as to define a receiving area;

a live hinge connecting said first ends of said jaw portions at a common base, said jaw portions and said live hinge being formed as a unitarily molded structure of a resiliently flexible material:

first and second, raised engagement surfaces formed on said second ends of said jaw portions on opposite sides of said receiving area;

an adjustment mechanism for adjustably urging said engagement surfaces on said jaw portions into gripping engagement with an article positioned within said receiving area, said adjustment mechanism comprising:

a threaded shaft that spans said first and second jaw portions at mid areas intermediate said engagement surfaces and said live hinge; and a finger operated knob that is in operative engagement with said shaft so as to urge said first and second jaw portions together in response to tightening of said knob; and at least one stop member positioned between said jaw portions so as to prevent said mid-areas of said jaw portions from collapsing towards one another beyond a predetermined minimum spacing as said finger operated knob is tightened, said stop member comprising:

a raised projection formed on said shaft for bearing against an inner surface of said mid-area of at least one of said jaw portions so as to limit movement of said jaw portion as said finger operated knob is tightened.

* * * * *